United States Patent [19]

Oberdorf

[11] Patent Number: 4,805,376

[45] Date of Patent: Feb. 21, 1989

[54] APPARATUS FOR EJECTING CIGARETTES FROM A MAGAZINE

[75] Inventor: Manfred Oberdorf, Gevelsberg, Fed. Rep. of Germany

[73] Assignee: Maschinenfabrik Alfred Schmermund GmbH & Co., Gevelsberg, Fed. Rep. of Germany

[21] Appl. No.: 104,640

[22] Filed: Oct. 2, 1987

[30] Foreign Application Priority Data

Oct. 4, 1986 [DE] Fed. Rep. of Germany ..... 3633865

[51] Int. Cl.[4] ..... B65B 19/12; B65B 5/06

[52] U.S. Cl. ..... 53/151; 198/468.1; 221/218; 221/253; 414/797.6; 414/797.9

[58] Field of Search ..... 53/148, 149, 151, 236, 53/259, 531, 150; 198/468.1, 550.11, 550.13, 419; 221/218, 253; 414/130, 131

[56] References Cited

U.S. PATENT DOCUMENTS

| | | | |
|---|---|---|---|
| 1,717,926 | 6/1929 | Horowitz | 221/253 |
| 1,980,641 | 11/1934 | Stone . | |
| 2,121,187 | 6/1938 | Crighton . | |
| 2,726,013 | 12/1955 | Rice et al. | 221/253 |
| 3,117,667 | 1/1964 | Tichy et al. | 198/419 |
| 3,468,407 | 9/1969 | Furst | 221/253 |
| 3,693,811 | 12/1972 | White | 414/130 |
| 3,746,212 | 7/1973 | Anderheggen et al. | 221/253 |

FOREIGN PATENT DOCUMENTS

| | | | |
|---|---|---|---|
| 444466 | 7/1925 | Fed. Rep. of Germany | 248/200 |
| 2327916 | 12/1973 | Fed. Rep. of Germany . | |
| 943100 | 7/1982 | U.S.S.R. . | |
| 1285851 | 8/1972 | United Kingdom | 254/419 |

*Primary Examiner*—Robert L. Spruill
*Assistant Examiner*—Beth Tenney
*Attorney, Agent, or Firm*—Chilton, Alix & Van Kirk

[57] ABSTRACT

An apparatus for ejecting a row of cigarettes from a cigarette magazine employs an endless conveyor which is actuable by means of a stepping drive. Ejector members fixed to the endless belt are moveable through the magazine case for ejecting the bottommost cigarette row. The endless conveyor employs a belt having a series of troughs which receive the bottommost cigarette row. The ejector members define the trailing boundary of the troughs.

17 Claims, 3 Drawing Sheets

APPARATUS FOR EJECTING CIGARETTES FROM A MAGAZINE

BACKGROUND OF THE INVENTION (1) Field of the Invention

This invention relates generally to methods and devices for imparting motion to previously oriented articles and particularly to apparatus for ejecting a row of cigarettes from a cigarette magazine. More specifically, the present invention relates to transport devices of a type which employ an endless conveyor, driven by means of a stepping drive, and ejectors that are movable through a cigarette magazine at a bottom region thereof.

(2) Description of the Prior Art

While not limited thereto in its utility, apparatus of the general type to which the present invention relates is disclosed in Federal Republic of Germany Patent A-444,466. This type of apparatus employs an endless conveyor in the form of a double chain. Ejectors are located between the two chains and are positionable under a cigarette magazine. The ejectors remove from the magazine, for further processing, the bottommost cigarette row which is arranged on a stationary, i.e. a carrier, plate. The apparatus of the aforementioned patent involves relatively expensive construction costs. In addition, the bottom portions of the cigarettes are, during movement by the ejectors, subject to significant frictional engagement which can result in damage to the cigarettes during the ejecting and conveying process.

U.S. Pat. Nos. 1,980,641 and 2,121,187 also disclose apparatus Which are related to the present invention.

Federal Republic of Germany Patent No. 2,327,916 discloses a system wherein rows of cigarettes fall into transport trolleys which are moved on an endless conveyor. However, although careful treatment of the cigarettes is achieved by use of a trolley arrangement, the construction is complex and thus the costs are relatively great as compared to other similar devices.

SUMMARY OF THE INVENTION

A principal object of the invention is to provide a new and improved apparatus of the aforementioned type having a relatively efficient and inexpensive construction while also providing an apparatus which treats previously arranged articles, cigarettes for example, in a careful and relatively damage-free manner. This object is achieved, in part, through the use of an endless conveyor in the form of a belt having troughs adapted for receiving the bottommost row of cigarettes from a magazine. Trough defining edges, which trail the troughs in relation to the conveyor direction of conveyance, form the ejector members. Consequently, the troughs of the endless conveyor belt serve both to eject, i.e., to receive, the cigarettes from the magazine and to subsequently transport the cigarettes.

The troughs are selectively dimensioned to facilitate reception of the cigarettes when the belt is driven. The belt is preferably a toothed belt. Portions of the belt which are located between the receiving troughs are elevated approximately one-half the thickness of a cigarette. Laterally extending notches traverse the width of the belts. A holding-down device is disposed above the belt on the ejection or downstream side of the cigarette magazine. A reciprocating pivotal slide is positioned adjacent the discharge end of the endless conveyor. A cam mechanism functions to govern the speed of the slide so that, at the moment of engagement of the slide with the row of cigarettes, the slide speed is commensurate with the speed of the conveyor. Subsequent to the moment of engagement, the slide speed is higher for ejecting the cigarette row from the endless conveyor. In one form of the invention, a parallelogram acting drive mechanism is inserted between the cam mechanism and the slide. A lever on a pivoting arm which is an actuable via a cam mechanism articulates the slide. One end of the lever is guided by a guide gib which functions to maintain the slide member in correct orientation to the end of the cigarettes.

DETAILED DESCRIPTION OF THE INVENTION

Figure 1:
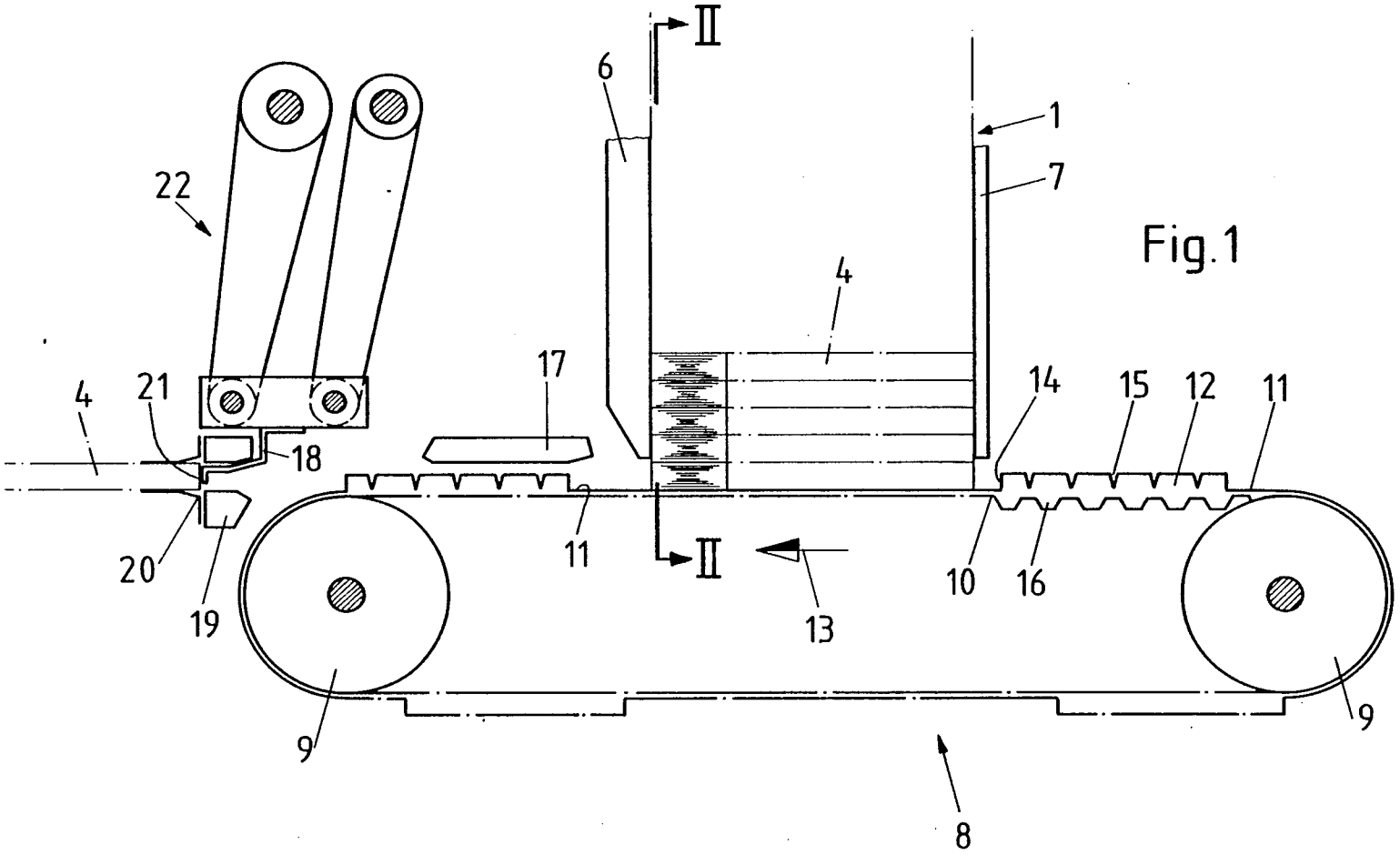
FIG. 1 is a schematic side elevation view of apparatus for ejecting cigarettes from a magazine in accordance with a first embodiment of the present invention.
Figure 2:
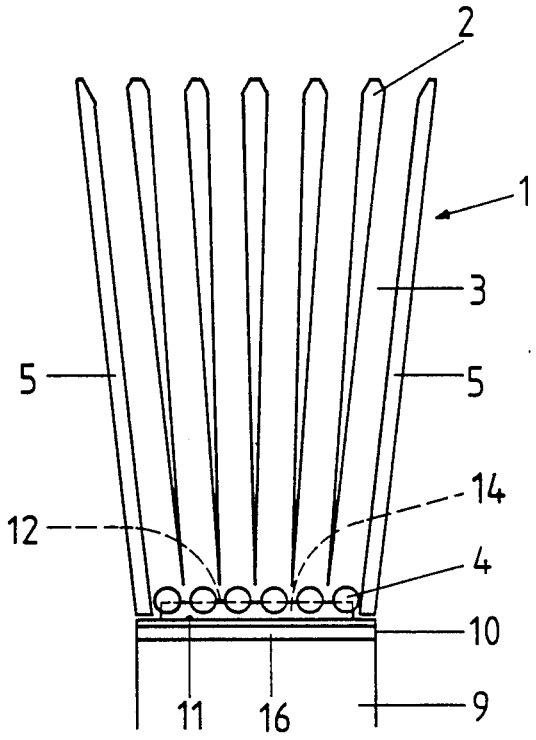
FIG. 2 is a sectional view taken along the line II—II of FIG. 1.

With reference to the drawings, wherein like numerals represent like parts throughout the figures, one embodiment of an apparatus for ejecting a row of cigarettes from a magazine is illustrated in FIGS. 1 and 2. The apparatus comprises a cigarette magazine 1 which is divided into individual separate feed channels or compartments 3 by means of partition walls 2. Cigarettes are loaded or fed into the magazine at the upper region and discharged through the lower bottom region. Vibrating rollers (not illustrated) may be arranged above the partition walls 2 at the upper feed region of the magazine.

The partition walls 2 extend downwardly so as to terminate a distance above the discharge end of the cigarette magazine 1 which is commensurate with the thickness or diameter of a cigarette for which the apparatus is adapted. Consequently, below the partition walls 2 there is space to accommodate a row of, for example, six cigarettes 4 which are positioned for ejection from the magazine. A row of cigarettes located below the walls 2 will be retained laterally by means of side walls 5 of the cigarette magazine. Transversely spaced front walls 6 and rear walls 7 of the magazine extend downwardly to terminate at a height which allows the bottommost cigarette row to be transversely ejected or removed from the magazine.

An endless conveyor, designated generally by the numeral 8, is positioned underneath the cigarette magazine 1. The endless conveyor 8 has a toothed belt 10 which is suspended between two transversely spaced rollers 9. A chain type belt or the like may also be employed. At least one of the rollers 9 is driven. Preferably, the roller 9 closest to the rear wall 7 of the cigarette magazine 1 is driven by means of a stepping drive (not illustrated in FIG. 1 but is shown at 33' in FIG. 3).

A series of substantially identical rectangular troughs 11 having an inner (lower) receiving surface are formed on the outwardly facing side of the toothed conveyor belt 10. Elevated rectangular shoulder portions 12, having leading and trailing edge faces 14, project outwardly from the belt in the longitudinal direction to define the troughs 11. The shoulder portions 12 project outwardly (upwardly) relative to the receiving surfaces of the troughs 11 a distance which is approximately one-half that of a cigarette diameter. The bottoms of the troughs 11 essentially function as the bottom receiving panel of the cigarette magazine 1. The shoulder portions 12 function as rams or ejectors and have a lateral width which is somewhat less than the distance between the side walls 5 of the cigarette magazine.

The troughs 11 receive, via gravity feed, the bottom-most cigarette row in the magazine. The leading edge faces 14 of the shoulder portions 12 in the conveying direction, denoted by arrow 13, define the trailing ends of the troughs and serve as stops for the received cigarettes 4. The troughs 11 and shoulder portions 12 are selectively dimensioned so that during each stroke or interval of the motive stepping drive, a cigarette row appears at the discharge end of the endless conveyor. As best illustrated in FIG. 1, the length of each trough 11 is greater than the length of the corresponding cigarettes 4 so that, regardless of the relatively high conveying speeds of the conveyor, sufficient time is afforded to allow the cigarettes 4 to descend or fall from the compartments 3 into the particular trough 11 located under the cigarette magazine 1.

The aforementioned dimensioning of the troughs 11 ensures that the cigarettes 4 will be carefully treated and essentially eliminates damage, even for relatively long transport paths, since there is no time requirement for a return stroke and the impact speed of the leading edge 14 is relatively low. The toothed belt 10 also functions to transport the cigarettes from the immediate vicinity of the magazine.

Generally U-shaped or V-shaped notches 15 laterally traverse the shoulder portions 12 so that rollers 9 of relatively small diameter may be employed for the endless conveyor 8. The transversely spaced notches are oriented generally perpendicular to the belt direction of conveying (arrow 13). The notches 15 are arranged in alternating fashion to complement the teeth 16 of the toothed belt. The notches 15 thus facilitate the guiding of the toothed belt, i.e., the notches prevent the toothed belt from disengaging from the rollers. The notches 15 are preferably commensurate in depth with the depth of the troughs 11. Because of the relatively thick composite belt configuration required for forming the troughs and shoulders, the notches 15 also function to impart sufficient flexibility to the belt to allow for a smooth, continuous, and uninterrupted drive engagement by the rollers 9.

A hold-down device 17 is positioned above the toothed belt 10 at the ejection side of the magazine. The hold-down device 17 forms a channel through which the row of cigarettes is conveyed to the discharge end of the endless conveyor 8.

A slide 18 having an engagement surface 21 engages the cigarette row for ejecting the cigarette row from the endless conveyor 8. The slide 18 pushes the cigarette row through a chute 19 into a cell 20 of a turret, cellular belt or the like. The engagement surface 21 of the slide 18 engages the rear face of the cigarette row in an orientation wherein the engagement surface 21 is parallel to, and upon engagement co-planar with, the rear ends of the cigarettes. The engagement orientation of the slide 18 thus guarantees a careful non-damaging engagement against the cigarettes 4.

The slide 18 is driven by a drive mechanism 22 which essentially imparts a parallelogram-type motion to the slide. The drive mechanism 22 pivots the slide 18 beyond the front edge (left in FIG. 1) of the hold-down device 17 and beyond the leading edge 14 of a shoulder 12 into engagement with the rear face of the cigarette row. The cigarette row is received in a corresponding trough 11 and therefore projects outwardly (upwardly) relative to the outer (upper) surface of the adjacent shoulder 12. A cam mechanism (not illustrated) for the parallelogram-acting drive mechanism 22 ensures that at the moment when the slide 18 engages against the rear face of the cigarette row, the speeds of the endless conveyor 8 and that of the slide 18 are substantially equivalent thereby providing a relatively soft, gentle engaging impact of the slide engagement surface 21 against the cigarettes. Subsequent to the initial moment of engagement, the ejector slide 18 is transformed to a higher motive speed for ejecting the row of cigarettes from the endless conveyor. During each cycle, the ejector slide 18 executes a reciprocating parallelogram-like pivoting movement. The parallelogram-like slide motion ensures that the engagement surface 21 maintains the parallel and co-planar engagement relationship with the ends of the cigarettes.

Figure 3:
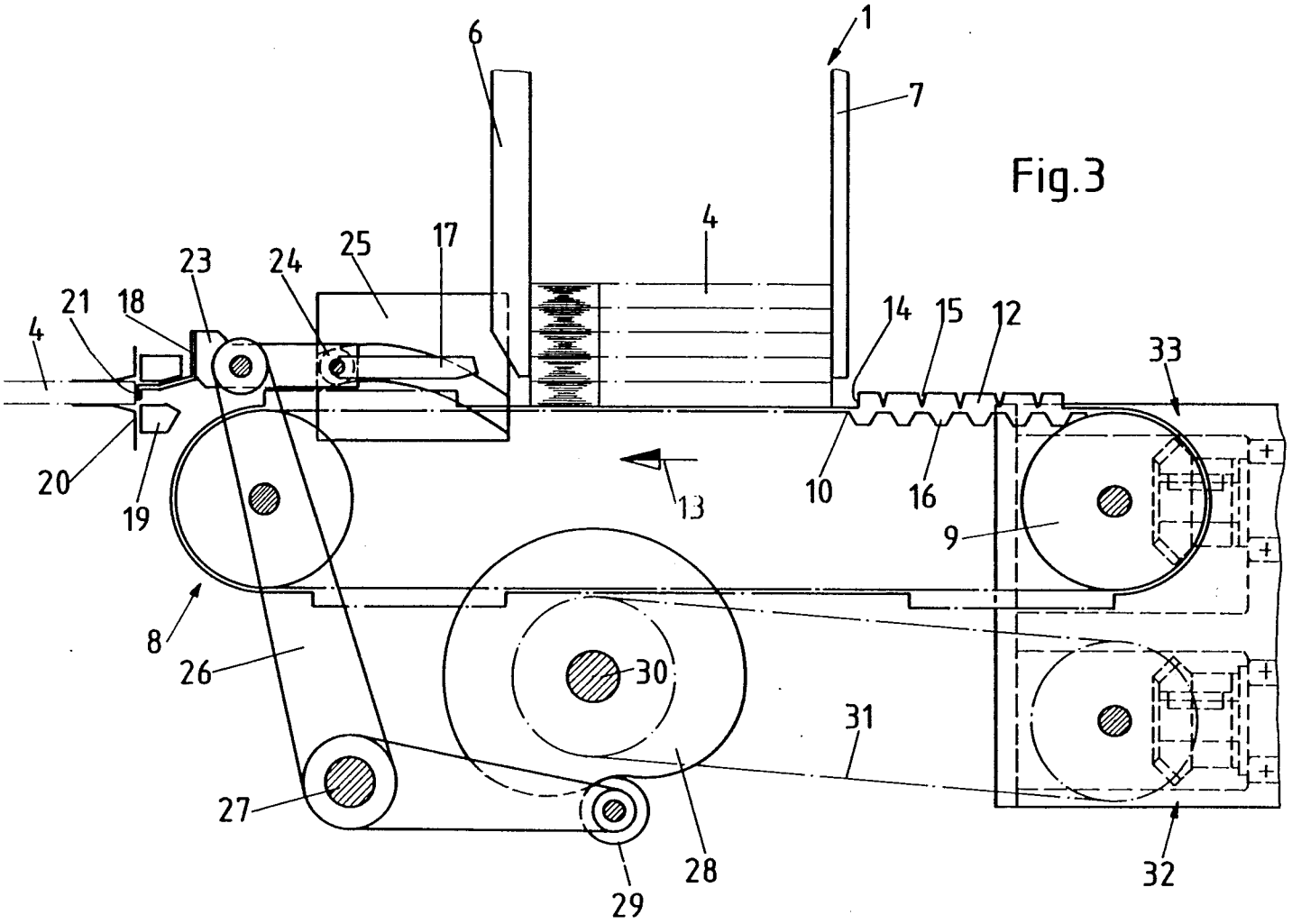
FIG. 3 is a schematic side elevation view of another embodiment of an apparatus for ejecting cigarettes from a magazine in accordance with the present invention.

A second embodiment of an apparatus for ejecting cigarettes from a cigarette magazine is illustrated in FIG. 3. The embodiment of FIG. 3 differs principally from the first described embodiment in the means whereby the row of cigarettes is ejected from the conveyor belt. The slide 18 is connected to the free end of a lever 23 The opposing end of lever 23 carries a roller 24. Roller 24 moves along a curved guide gib 25. The lever 23 is rotatably articulated, at a central position thereof, to the first end of a pivot arm 26. The second end of arm 26 is connected to a shaft 27. Arm 26 is pivotable through an angle as a result of the reciprocal motion imparted to shaft 27. The roller 24 and the guide gib 25 cooperate to ensure that the engagement surface 21 of the slide 18 continuously maintains an orientation which is parallel to the rear ends of the cigarette row. The engagement orientation thus eliminates the potential for damaging engagement impact against the cigarettes by the engagement surface.

A shaft 30 is rotatably coupled, via a belt 31, to a drive 32. Drive 32 is positioned adjacent to the stepping drive 33 for the rollers 9. A cam disc 28 is fixed to shaft 30 for rotation therewith. A follower 29 engages the cam disc and functions, via a lever arm, to impart motion to the shaft 27. The cam disc 28 functions as a speed control so that the speed of the slide 18 is substantially equal to the speed of the conveyor belt 10 upon initial engagement of the slide with the row of cigarettes. The speed of the slide is then subsequently transformed to a higher speed through the cam disc 28 control. The embodiment of FIG. 3 comprises an apparatus wherein the cigarette magazine 1 is more accessible in the event there is a fault or disruption of the apparatus at the magazine.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed:

1. Apparatus for ejecting a row of generally aligned cigarettes from a magazine, the cigarettes being loaded into the magazine at an upper region thereof and being discharged through a discharge end of the magazine at the bottom thereof, the cigarettes being arranged within the magazine in side-by-side vertical stacks so as to form a bottom-most cigarette row, the cigarettes in the bottom-most row having leading and trailing ends in the direction of movement during ejection thereof from the magazine, the magazine discharge end generally defining a plane, said apparatus comprising:

conveyor means positioned below the magazine and being partly in registration with the magazine, said conveyor means including an endless conveyor belt which is movable relative to the magazine discharge end, said conveyor means belt including a plurality of spaced troughs formed on the side of said belt which faces the magazine discharge end, said troughs each being in part defined by an ejector surface, said ejector surfaces engaging the trailing ends of the cigarettes in the bottom-most row during the movement of said conveyor means belt whereby the bottom-most row of cigarettes is received in a said trough and is moved with said conveyor means belt under the influence of a said ejector surface;

drive means for imparting step-wise motion to said conveyor means belt; and transversely movable slide means for engaging the trailing end of a row of cigarettes received in a said trough and ejecting said row of cigarettes from the said trough after the row has been moved out of registration with the magazine.

2. The apparatus of claim 1 wherein the endless conveyor belt is a toothed belt.

3. The apparatus of claim 1 wherein said troughs each include a receiving surface and wherein said conveyor means belts includes a shoulder portion disposed between each of said troughs, said shoulder portions projecting from the receiving surfaces of said troughs a distance which is approximately one-half the thickness of a cigarette, a first side of each of said shoulder portions being at least in part formed by a said ejector surface.

4. The apparatus of claim 3 wherein the belt has a generally uniform lateral width and further comprising a plurality of notches traversing the shoulder portions and extending the lateral width thereof.

5. The apparatus of claim 3 further comprising holding down means disposed above said endless conveyor means belt for engaging the cigarettes received in a said trough and maintaining said cigarettes in received relationship within said trough.

6. The apparatus of claim 5 wherein said endless conveyor means belt is a toothed belt.

7. The apparatus of claim 6 wherein said conveyor means belt has a generally uniform lateral width and further comprises a plurality of notches traversing said shoulder portions and extending the lateral width thereof.

8. The apparatus of claim 6 further comprising speed control means for regulating the transverse speed of said slide means so that the speed of the slide means and the conveyor means belt is substantially equivalent at the moment of initial engagement of the slide means with the cigarettes and at a subsequent time the transverse speed of the slide means is greater than that of the endless conveyor means belt.

9. The apparatus of claim 3 further comprising speed control means for regulating the transverse speed of said slide means so that the speed of the slide means and the conveyor means belt is substantially equivalent at the moment of initial engagement of the slide means with the cigarettes and at a subsequent time the transverse speed of the slide means is greater than that of the endless conveyor means belt.

10. The apparatus of claim 1 further comprising holding down means disposed above said endless belt for engaging the cigarette received in a said trough and maintaining said cigarettes in received relationship within said trough.

11. The apparatus of claim 1 further comprising speed control means for regulating the transverse speed of said slide means so that the speed of the slide means and the conveyor means belt is substantially equivalent at the moment of initial engagement of the slide means with the cigarettes and at a subsequent time the transverse speed of the slide means is greater than that of the endless conveyor belt.

12. The apparatus of claim 11 wherein the speed control means further comprises a cam means for reciprocally pivoting the slide means.

13. The apparatus of claim 12 wherein said slide means is driven in a parallelogram-type reciprocating action by a drive means operatively disposed between the cam means and the slide means.

14. The apparatus of claim 12 further comprising a lever and a connecting pivoting arm, said pivoting arm being actuable via the cam means to drive a lever for reciprocating the slide means.

15. The apparatus of claim 14 further comprising a guide gib and wherein said lever has one end which is guided by said guide gib so that said slide means engages the cigarettes at substantially the same angle of engagement throughout the period of slide means engagement with the cigarettes.

16. The apparatus of claim 1 wherein said troughs each include a receiving surface and wherein said conveyor means belt includes a shoulder portion disposed between each of said troughs, said shoulder portions projecting from the receiving surfaces of said troughs a distance which is approximately one-half the thickness of a cigarette, a first of side of each of said shoulder portions being at least in-part formed by a said ejector surface.

17. The apparatus of claim 16 wherein said conveyor means belt has a generally uniform lateral width and further comprises a plurality of notches traversing said shoulder portions and extending the lateral width thereof.

* * * * *

UNITED STATES PATENT AND TRADEMARK OFFICE

CERTIFICATE OF CORRECTION

PATENT NO. : 4,805,376

DATED : February 21, 1989

INVENTOR(S) : Manfred Oberdorf

It is certified that error appears in the above-identified patent and that said Letters Patent is hereby corrected as shown below:

In column 1, line 33, "Which" should read --which--.

In column 2, line 60, "33'" should read --33--.

In column 4, line 28, insert a period after "23" (first occurrence).

In column 6, line 44, "1" should read --2--.

In column 6, line 50, after "first" delete "of".

Signed and Sealed this

Twenty-second Day of May, 1990

*Attest:*

*Attesting Officer*

HARRY F. MANBECK, JR.

*Commissioner of Patents and Trademarks*